US011677193B2

(12) United States Patent
Jack

(10) Patent No.: US 11,677,193 B2
(45) Date of Patent: Jun. 13, 2023

(54) POWER STRIP ASSEMBLY WITH SWITCH CONTROLLED OUTLET BANKS

(71) Applicant: Carl Eugene Jack, Monrovia, CA (US)

(72) Inventor: Carl Eugene Jack, Monrovia, CA (US)

( * ) Notice: Subject to any disclaimer, the term of this patent is extended or adjusted under 35 U.S.C. 154(b) by 180 days.

(21) Appl. No.: 17/192,298

(22) Filed: Mar. 4, 2021

(65) Prior Publication Data

US 2022/0285892 A1 Sep. 8, 2022

(51) Int. Cl.

| | |
|---|---|
| ***H01R 13/70*** | (2006.01) |
| ***H01R 25/00*** | (2006.01) |
| *H01R 13/10* | (2006.01) |
| *H01R 13/04* | (2006.01) |

(52) U.S. Cl.

CPC ..... *H01R 13/70* (2013.01); *H01R 25/003* (2013.01); *H01R 13/04* (2013.01); *H01R 13/10* (2013.01)

(58) Field of Classification Search

CPC ..... H01R 13/04; H01R 13/10; H01R 13/70–25/003

See application file for complete search history.

(56) References Cited

U.S. PATENT DOCUMENTS

| | | | | |
|---|---|---|---|---|
| 5,359,540 | A | 10/1994 | Ortiz | |
| 5,430,598 | A | 7/1995 | Rodolfo | |
| 5,649,839 | A | 7/1997 | Yu | |
| 6,750,410 | B2 | 6/2004 | Lee | |
| 9,742,127 | B2 | 8/2017 | Magee, Jr. | |
| D796,445 | S | 9/2017 | Xu | |
| 9,800,003 | B1 * | 10/2017 | Chen | H01R 13/70 |
| 2009/0146494 | A1 | 6/2009 | Mori | |
| 2011/0097926 | A1 | 4/2011 | Bowen | |

FOREIGN PATENT DOCUMENTS

| | | | | |
|---|---|---|---|---|
| KR | 20-2011-0000483 | * | 1/2011 | H01R 12/514 |

* cited by examiner

*Primary Examiner* — Vanessa Girardi

(57) ABSTRACT

A power strip assembly for facilitating electrical devices plugged into a power strip to be individually turned on and off includes a power strip that is longitudinally elongated and a plurality of banks of female electrical outlets integrated into the power strip. A plurality of power switches is each movably coupled to the power strip. Each of the power switches is in electrical communication with a respective one of the banks of female electrical outlets for turning the respective banks of female electrical outlets on and off. In this way the plurality of power switches can turn off respective electrical devices plugged into the power strip while leaving respective electrical devices plugged into the power strip turned on.

5 Claims, 8 Drawing Sheets

POWER STRIP ASSEMBLY WITH SWITCH CONTROLLED OUTLET BANKS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to power strip devices and more particularly pertains to a new power strip device for facilitating electrical devices plugged into a power strip to be individually turned on and off.

(2) Description of Related Art Including Information Disclosed Under 37 CFR 1.97 and 1.98

The prior art relates to power strip devices including a power strip that includes data cables to facilitate a computer or a printer to be turned off independently. The prior art disclose a power strip that has timers integrated therein for turning electrical devices on and off at a pre-determined time. The prior art discloses a variety of power strips that include a plurality of switches each assigned to electrical outlets for turning each of the electrical outlets on and off. The prior art discloses a power strip that has a sequence control module for sequentially turning outlets on and off. The prior art further discloses a power strip that is wirelessly controlled for turning each outlet on and off on the power strip.

BRIEF SUMMARY OF THE INVENTION

An embodiment of the disclosure meets the needs presented above by generally comprising a power strip that is longitudinally elongated and a plurality of banks of female electrical outlets integrated into the power strip. A plurality of power switches is each movably coupled to the power strip. Each of the power switches is in electrical communication with a respective one of the banks of female electrical outlets for turning the respective banks of female electrical outlets on and off. In this way the plurality of power switches can turn off respective electrical devices plugged into the power strip while leaving respective electrical devices plugged into the power strip turned on.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
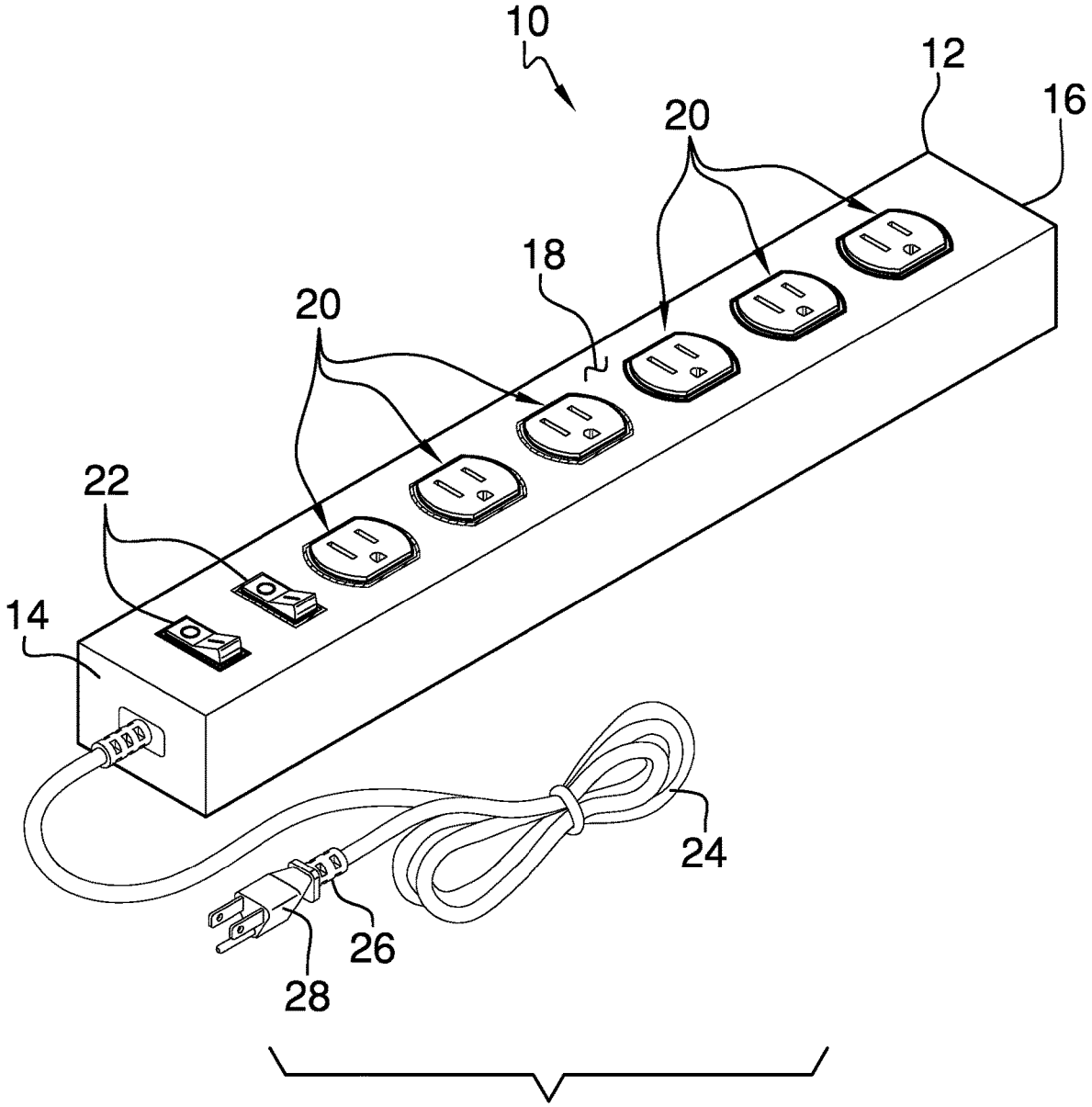
FIG. 1 is a top perspective view of a power strip assembly according to an embodiment of the disclosure.
Figure 2A:
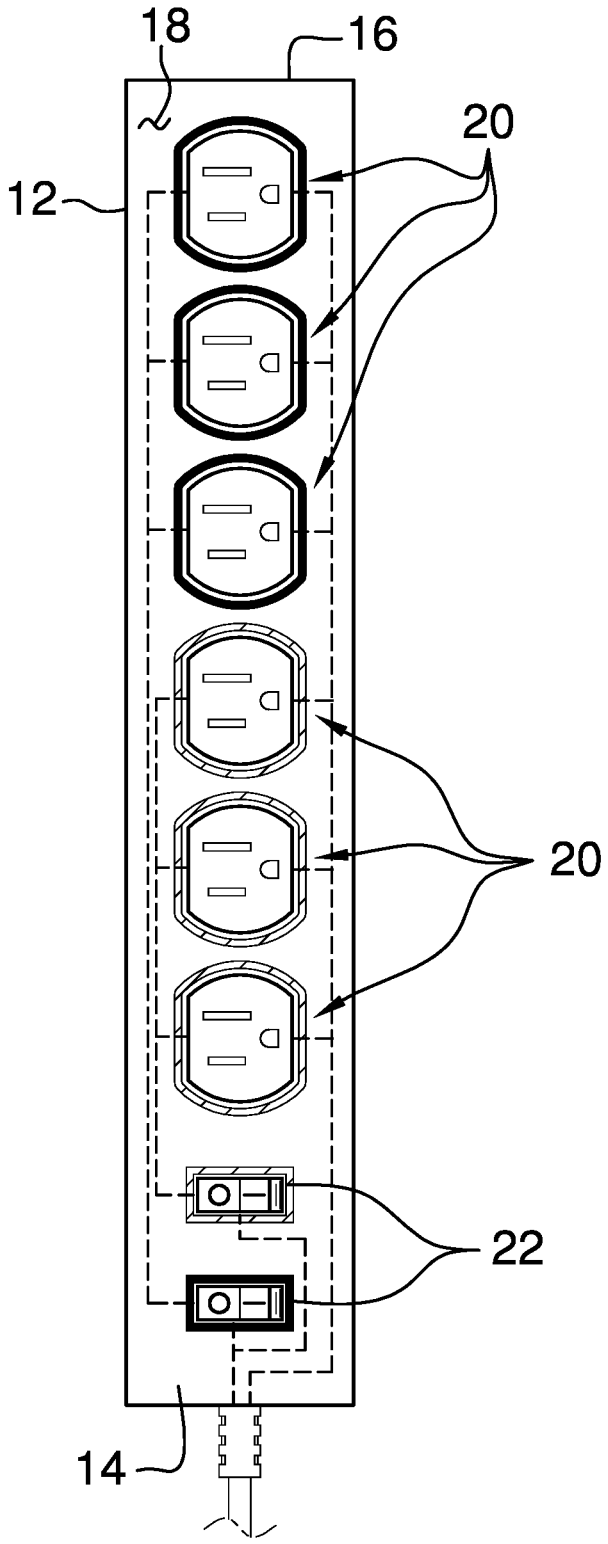
FIG. 2A is a top phantom view of an embodiment of the disclosure.
Figure 2B:
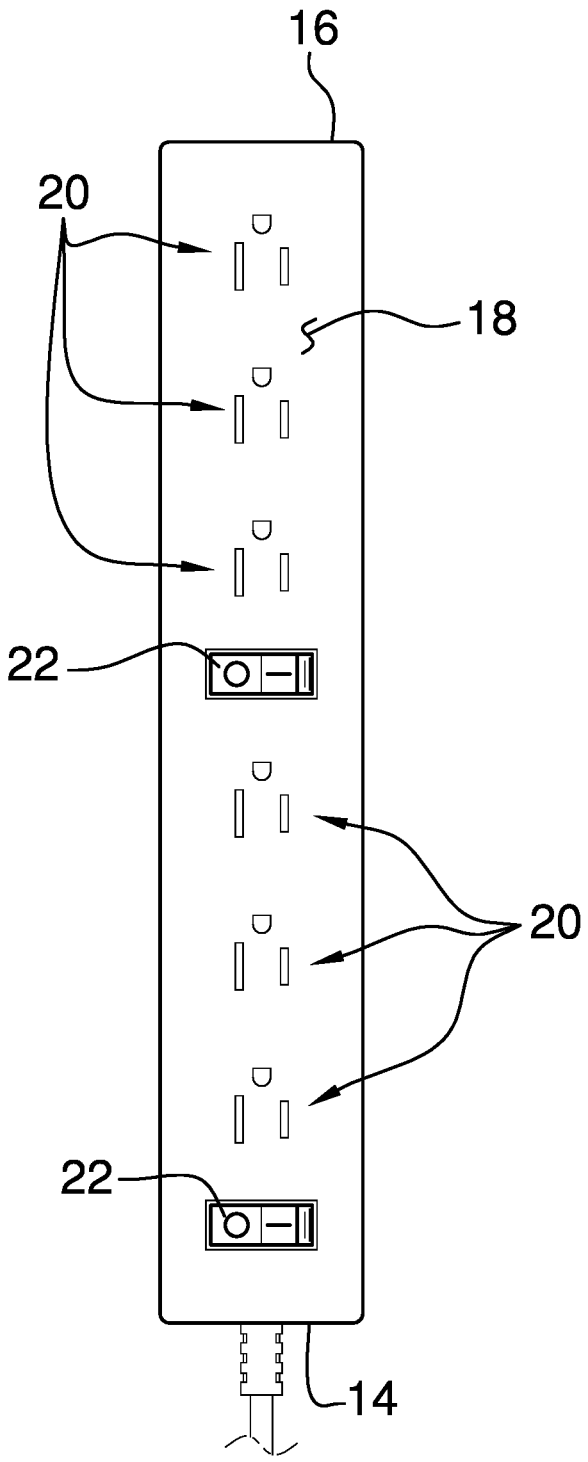
FIG. 2B is a top view of an embodiment of the disclosure.
Figure 3:
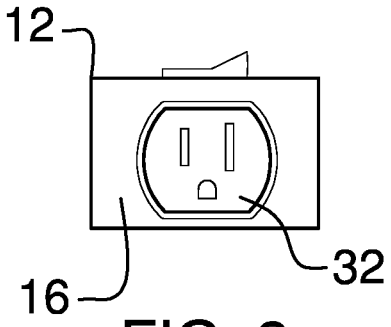
FIG. 3 is a front view of an embodiment of the disclosure.
Figure 4:
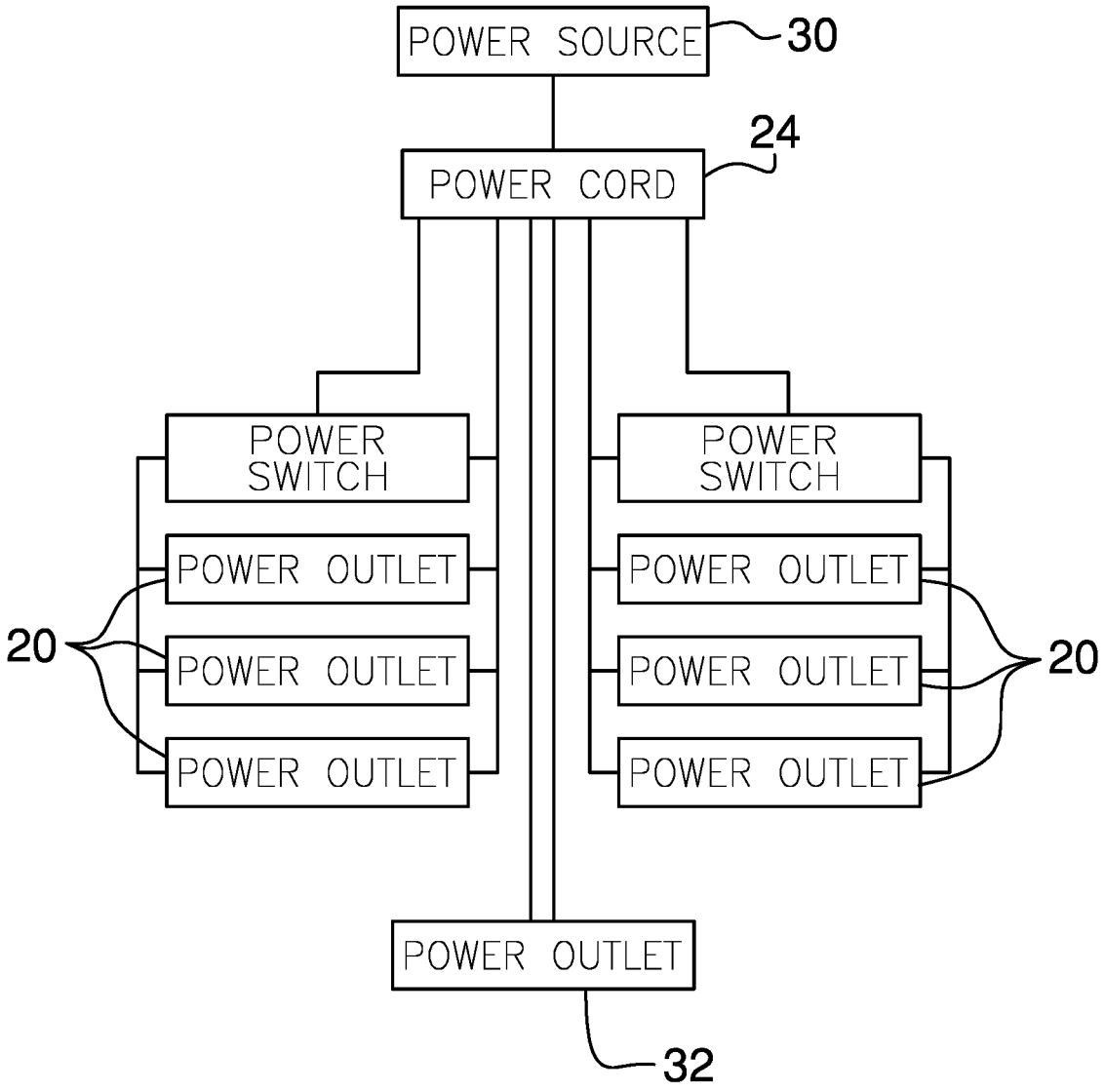
FIG. 4 is a schematic view of an embodiment of the disclosure.

With reference now to the drawings, and in particular to FIGS. 1 through 9 thereof, a new power strip device embodying the principles and concepts of an embodiment of the disclosure and generally designated by the reference numeral 10 will be described.

As best illustrated in FIGS. 1 through 9, the power strip assembly 10 generally comprises a power strip 12 that is longitudinally elongated. The power strip 12 has a first end 14, a second end 16 and a top surface 18 extending therebetween, and the power strip 12 is elongated between the first end 14 and the second end 16. A plurality of banks of female electrical outlets 20 is each integrated into the power strip 12. Each of the banks of female electrical outlets 20 is positioned on the top surface 18 and the banks of female electrical outlets 20 are distributed along an axis extending between the first end 14 and the second end 16. Moreover, each of the banks of female electrical outlets 20 is electrically insulated from each other. Each of the banks of female electrical outlets 20 may be color coded with each other for distinguishing the banks of female electrical outlets 20 from each other. Additionally, the female electrical outlets 20 might include various other markings to distinguish the female electrical outlets 20 from each other.

A plurality of power switches 22 is provided and each of the power switches 22 is movably coupled to the power strip 12. Each of the power switches 22 is in electrical communication with a respective one of the banks of female electrical outlets 20. Moreover, the power switches 22 turns the respective banks of female electrical outlets 20 on and off. In this way the plurality of power switches 22 can turn off respective electrical devices plugged into the power strip 12 while leaving respective electrical devices plugged into the power strip 12 turned on. Each of the power switches 22 is positioned on the top surface 18 of the power strip 12. As is most clearly shown in FIGS. 1, 2A and 5, each of the power switches 22 may be positioned between the plurality of banks of female electrical outlets 20 and the first end 14 of the power strip 12. As is most clearly shown in FIGS. 2B and 5, each of the power switches 22 may be positioned between respective pairs of the banks of female electrical outlets 20.

A power cord 24 is coupled to and extends away from the first end 14 of the power strip 12. Additionally, the power cord 24 is electrically coupled to each of the power switches 22. The power cord 24 has a distal end 26 with respect to the power strip 12 and a male electrical plug 28 is electrically coupled to the distal end 26. The male electrical plug 28 can be plugged into a power source 30 comprising a female electrical outlet. As is most clearly shown in FIG. 3, a terminal female electrical outlet 32 may be integrated into the second end 16 of the power strip 12. Additionally, the terminal female electrical outlet 32 may be electrically coupled to a respective one of the power switches 22.

Figure 5:
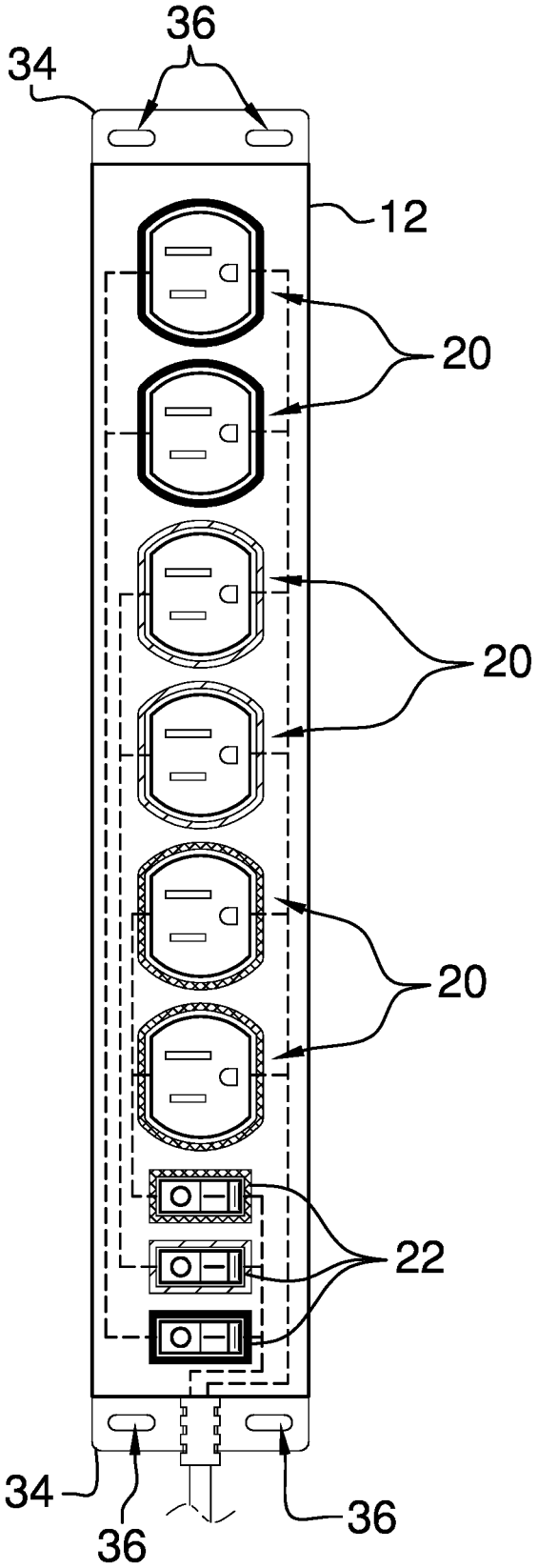
FIG. 5 is a top perspective phantom view of an embodiment of the disclosure.
Figure 6:
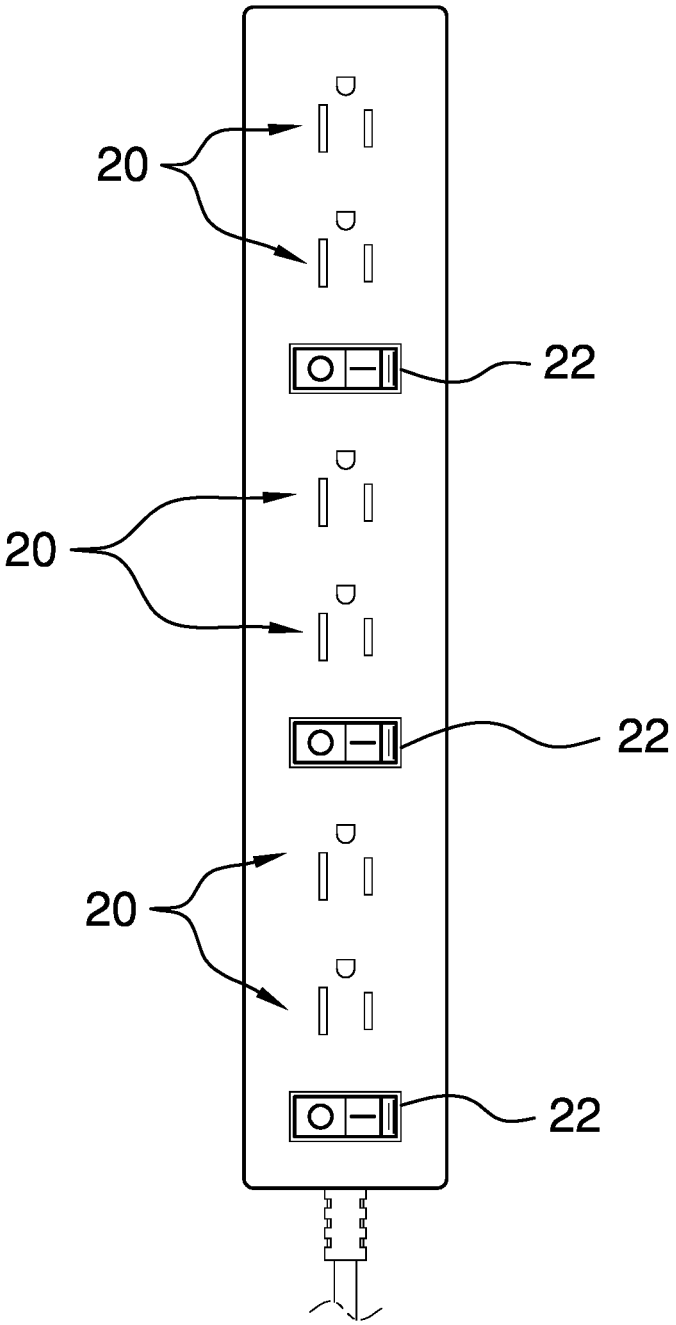
FIG. 6 is a top perspective view of an embodiment of the disclosure.
Figure 7:
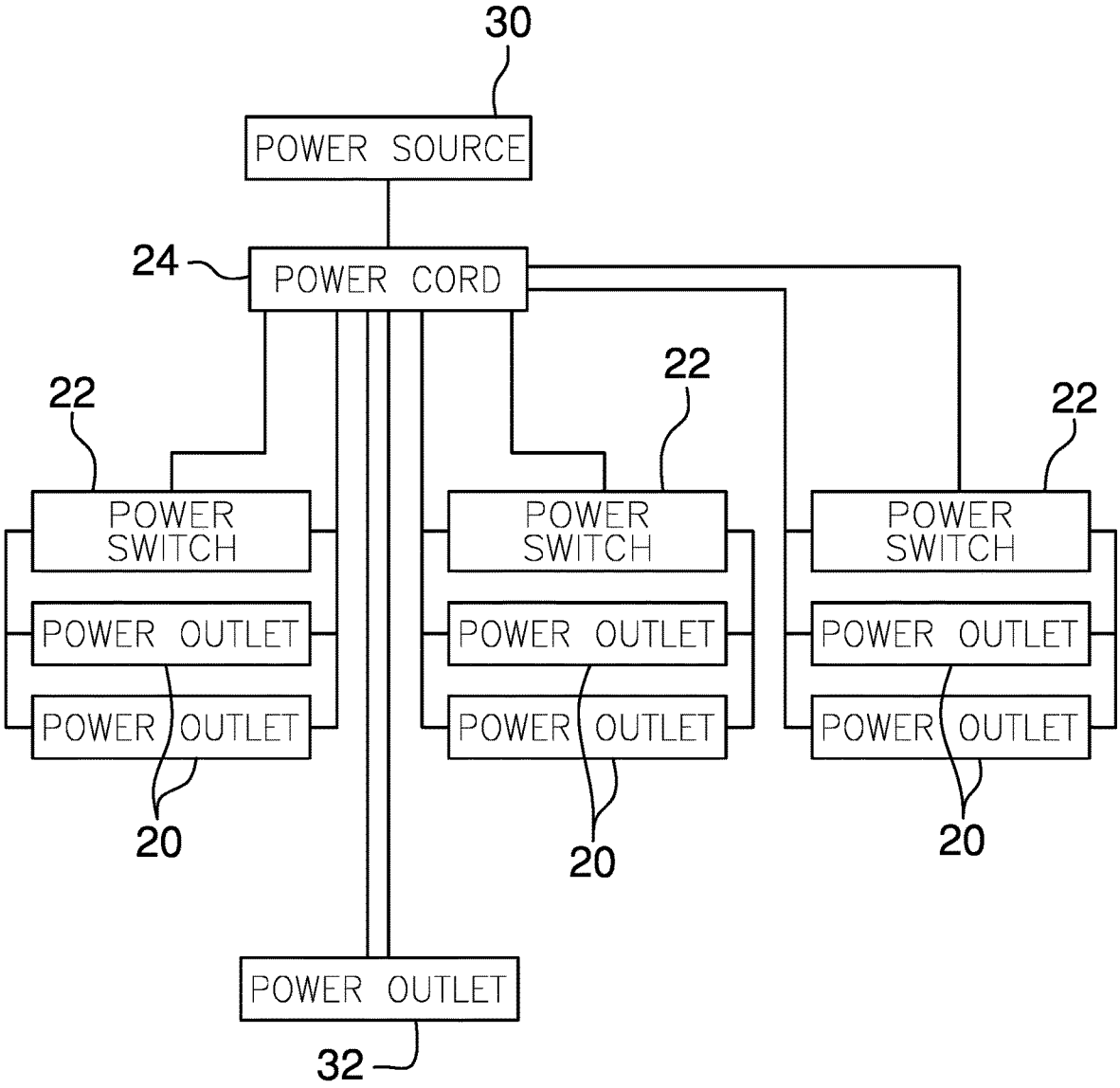
FIG. 7 is a schematic view of an embodiment of the disclosure.
Figure 8:
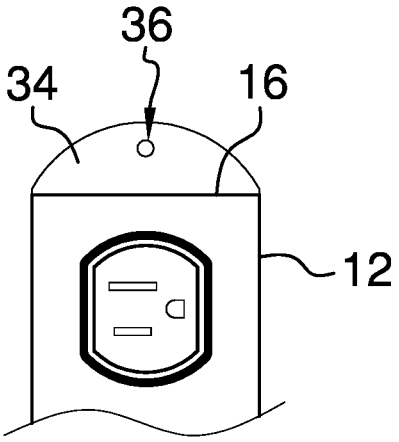
FIG. 8 is a top view of an embodiment of the disclosure showing a tab mounted to a power strip.
Figure 9:
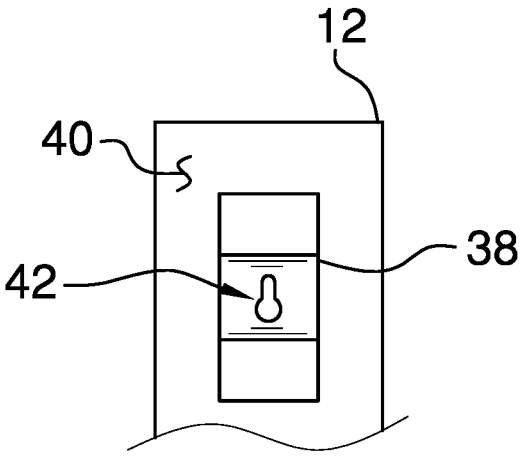
FIG. 9 is a bottom view of an embodiment of the disclosure.

As is most clearly shown in FIG. 5, a pair of tabs 34 may each being coupled to and extend away from a respective one of the first end 14 and the second end 16 of the power strip 12. Each of the tabs 34 may have slots 36 extending therethrough for accommodating a screw, or other fastener, to attach the power strip 12 to a support surface. Additionally, the tabs 34 may have a rectangular shape. As is most clearly shown in FIG. 8, the tabs 34 may be rounded. As is most clearly shown in FIG. 9, a mount 38 may be coupled to a bottom surface 40 of the power strip 12 and the mount 38 may have a slot 42 extending therethrough for accommodating a screw, or other fastener, to attach the power strip 12 to a support surface.

In use, selected electronic devices are plugged into a respective female electrical outlet of a respective bank of the female electrical outlets 20 on the power strip 12. The male electrical plug 28 on the power cord 24 is plugged into the power source 30. Respective ones of the power switches 22 are turned on to turn on the electronic devices that are plugged into the respective bank of female electrical outlets 20. In this way some of the electronic devices can be turned off and some of the electronic devices can be turned on while all of the electronic devices are all plugged into the same power strip 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power strip assembly comprising:

a power strip being longitudinally elongated;

a plurality of banks of female electrical outlets, each of said banks of female electrical outlets being integrated into said power strip;

a plurality of power switches, each of said power switches being movably coupled to said power strip wherein each of said power switches is configured to be manipulated by a user, each of said power switches being in electrical communication with a respective one of said banks of female electrical outlets for turning said respective banks of female electrical outlets on and off wherein said plurality of power switches is configured to turn off respective electrical devices plugged into said power strip while leaving respective electrical devices plugged into said power strip turned on;

wherein said power strip has a first end, a second end and a top surface extending therebetween;

wherein each of said banks of female electrical outlets is positioned on said top surface, said banks of female electrical outlets being distributed along an axis extending between said first end and said second end; and wherein each of said power switches is positioned on said top surface of said power strip, each of said power switches being positioned between said plurality of banks of female electrical outlets and said first end of said power strip.

2. The assembly according to claim 1, wherein each of said banks of female electrical outlets is electrically insulated from each other.

3. The assembly according to claim 1, further comprising a power cord being coupled to and extending away from said first end of said power strip, said power cord being electrically coupled to each of said power switches, said power cord having a distal end with respect to said power strip, said distal end having a male electrical plug being electrically coupled thereto wherein said male electrical plug is configured to be plugged into a power source comprising a female electrical outlet.

4. A power strip assembly comprising:

a power strip being longitudinally elongated, said power strip having a first end, a second end and a top surface extending therebetween, said power strip being elongated between said first end and said second end;

a plurality of banks of female electrical outlets, each of said banks of female electrical outlets being integrated into said power strip, each of said banks of female electrical outlets being positioned on said top surface, said banks of female electrical outlets being distributed along an axis extending between said first end and said second end, each of said banks of female electrical outlets being electrically insulated from each other;

a plurality of power switches, each of said power switches being movably coupled to said power strip wherein each of said power switches is configured to be manipulated by a user, each of said power switches being in electrical communication with a respective one of said banks of female electrical outlets for turning said respective banks of female electrical outlets on and off wherein said plurality of power switches is configured to turn off respective electrical devices plugged into said power strip while leaving respective electrical devices plugged into said power strip turned on, each of said power switches being positioned on said top surface of said power strip, each of said power switches being positioned between said plurality of banks of female electrical outlets and said first end of said power strip; and a power cord being coupled to and extending away from said first end of said power strip, said power cord being electrically coupled to each of said power switches, said power cord having a distal end with respect to said power strip, said distal end having a male electrical plug being electrically coupled thereto wherein said male electrical plug is configured to be plugged into a power source comprising a female electrical outlet.

5. The assembly according to claim 4, further comprising a terminal female electrical outlet being integrated into said second end of said power strip, said terminal female electrical outlet being electrically coupled to a respective one of said power switches.

* * * * *